US006183146B1

(12) United States Patent
Kusunoki

(10) Patent No.: US 6,183,146 B1
(45) Date of Patent: Feb. 6, 2001

(54) DRIER DEVICE FOR PHOTOSENSITIVE MATERIAL

(75) Inventor: Naoki Kusunoki, Kanagawa (JP)

(73) Assignee: Fuji Photo Film Co., Ltd., Kanagawa (JP)

( * ) Notice: Under 35 U.S.C. 154(b), the term of this patent shall be extended for 0 days.

(21) Appl. No.: 09/328,001

(22) Filed: Jun. 8, 1999

(30) Foreign Application Priority Data

Jun. 12, 1998 (JP) ..... 10-165436

(51) Int. Cl.[7] ..... G03D 7/00
(52) U.S. Cl. ..... 396/579; 34/643; 34/638
(58) Field of Search ..... 396/579; 34/245, 34/265, 266, 638, 643

(56) References Cited

U.S. PATENT DOCUMENTS 3,577,651 * 5/1971 Nichols ..... 34/638
5,150,955 * 9/1992 Devaney, Jr. et al. ..... 396/620

FOREIGN PATENT DOCUMENTS 9-43826 2/1997 (JP) ..... G03D/15/02

* cited by examiner

*Primary Examiner*—D. Rutledge
(74) *Attorney, Agent, or Firm*—Sughrue, Mion, Zinn, Macpeak & Seas, PLLC

(57) ABSTRACT

A photographic paper drier device includes a conveyor belt for conveying the photographic paper along a conveying path. A fan or blower dries the photographic paper by application of air thereto while the photographic paper is conveyed along the conveying path. The fan or blower sends the air into an air blow case, which has an air blow wall extending along the conveying path, and being positioned opposite to the photographic paper. Plural outlet slits are formed through the air blow wall, and blow the photographic paper with the air. Each of the outlet slits extends in a crosswise direction crosswise to the conveying path. The outlet slits are arranged in 18 trains arranged along the conveying path. Each of the outlet slits has a length smaller than a width of the photographic paper.

18 Claims, 6 Drawing Sheets

DRIER DEVICE FOR PHOTOSENSITIVE MATERIAL

BACKGROUND OF THE INVENTION

1. Field of the Invention

The present invention relates to a drier device for photosensitive material. More particularly, the present invention relates to a photosensitive material drier device, in which the photosensitive material can be protected from being damaged or jammed.

2. Description Related to the Prior Art

There are various automatic photosensitive material processors, including a photo film processor and a printer/processor. The printer/processor consists of a printer component in which images on developed photo film are printed on color paper, and a processor component for automatically developing the color paper. The processor component includes a drier device for drying photographic paper after being processed with various kinds of procession solution. There is a known type of drier device including nip rollers or rollers arranged in a zigzag manner, which contact an emulsion surface of the photographic paper for conveying the photographic paper. A serious problem occurs in this type as the rollers are likely to create damages due to the contact, traces occurring upon pressure of the rollers, unevenness in surface gloss, or the like. This problem is very remarkable as the photographic paper is still wet to a halfway extent before the end of the drying operation.

There are known techniques in which a fan for suction is used for conveyance in suction of the photographic paper, or air for drying is applied to the photographic paper on an endless conveyor belt to keep the photographic paper in tight contact with the endless conveyor belt. Another suggestion is disclosed in JP-A 9-43826, a Japanese patent application filed by the assignor of the present application. A photosensitive material drier device includes a fan suitable for blowing the photographic paper on the endless conveyor belt with air sent through an air blow case, and includes an air intake case behind the endless conveyor belt for suction of the photographic paper to the endless conveyor belt, for the purpose of reliable conveyance.

However the known drier device has such shortcomings that irregularities in the drying occur, that front corners of the photographic paper are likely to enter slits formed in the air blow case to extend in the width direction of the photographic paper, and that jamming of the photographic paper occurs. Even when the photographic paper is not jammed, the corners may be bent and seriously damaged.

SUMMARY OF THE INVENTION

In view of the foregoing problems, an object of the present invention is to provide a drier device for photosensitive material, in which it is possible to avoid occurrence of irregularities in drying, and jamming of the photosensitive material.

In order to achieve the above and other objects and advantages of this invention, a drier device for photosensitive material includes a conveyor for conveying the photosensitive material along a predetermined conveying path. A fan or blower dries the photosensitive material by application of air thereto while the photosensitive material is conveyed along the conveying path. There is an air blow case into which the fan or blower sends the air, the air blow case having an air blow wall extending along the conveying path, and being positioned opposite to the photosensitive material. Plural outlet slits are formed through the air blow wall, for blowing the photosensitive material with the air. Each of the outlet slits extends in a crosswise direction crosswise to the conveying path, the outlet slits are arranged in N trains arranged along the conveying path, and each of the outlet slits has a length smaller than a width of the photosensitive material.

In a preferred embodiment, the N trains include first and second trains. The first train includes P of the plural outlet slits arranged in the crosswise direction. The second train is disposed adjacent to the first train with reference to the conveying path, includes Q of the plural outlet slits, arranged in the crosswise direction, and offset in the crosswise direction from the P outlet slits.

Furthermore, an outer inclined guiding surface is disposed on one of two edges of the outlet slits located downstream with reference to the conveying path, and formed with an inclination by chamfering, for preventing the outlet slits from interfering with an edge of the photosensitive material.

Furthermore, an inner inclined guiding surface is formed with the air blow wall and inside the air blow case, and inclined by chamfering at least one of two edges of the outlet slits.

Furthermore, a straightener is disposed in the air blow case, for regularizing a flow rate of the air between the plural outlet slits.

Furthermore, an air blow duct introduces the air from the fan or blower to the air blow case. The air blow case further includes a duct connecting gap connected with the air blow duct. The straightener introduces part of the air to ones of the outlet slits farther from the duct connecting gap with reference to the crosswise direction.

The air blow case further includes an extension portion disposed to extend from the air blow wall in the crosswise direction, and having the duct connecting gap formed therein. The straightener includes at least one plate having first and second edges, the first edge being positioned opposite to one middle position in the duct connecting gap, and the second edge being positioned opposite to one middle position in the air blow wall.

The air blow case further includes a base wall disposed opposite to the air blow wall. The straightener is disposed on the base wall, away from the duct connecting gap in the crosswise direction, and with an inclination to come nearer to the air blow wall in the crosswise direction.

The air blow wall is produced from resin.

A proportion of a total of open areas of the outlet slits to an area of the air blow wall is 5–20%.

The conveyor includes a conveyor belt, and the conveyor belt has a plurality of air openings.

Furthermore, a push roller is positioned opposite to an end of the conveyor belt disposed downstream with reference to the conveying path, for nipping the photosensitive material in cooperation with the conveyor belt. A guiding plate is disposed near to the push roller, for introducing the photosensitive material toward the push roller.

Furthermore, an air intake duct is connected with the fan or blower on a side opposite to the air blow case. An air intake case is connected with the air intake duct, for covering a back of the conveyor belt, to introduce the air to the fan or blower, and to suck the photosensitive material in contact with the conveyor belt.

BRIEF DESCRIPTION OF THE DRAWINGS

The above objects and advantages of the present invention will become more apparent from the following detailed description when read in connection with the accompanying drawings, in which.

DETAILED DESCRIPTION OF THE PREFERRED EMBODIMENT(S) OF THE PRESENT INVENTION

Figure 1:
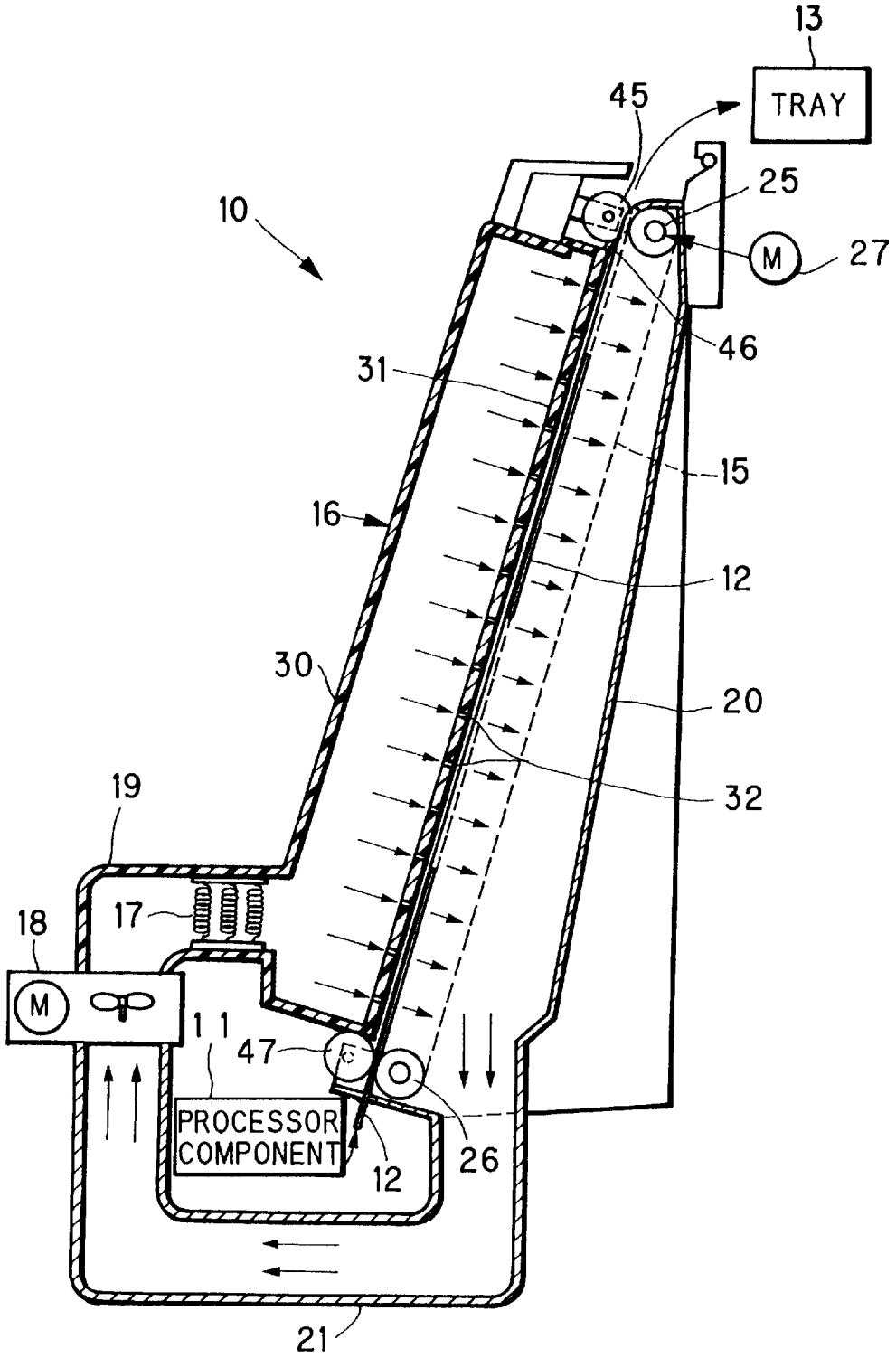
FIG. 1 is an explanatory view in vertical section, illustrating a drier device of the present invention.

In FIG. 1, a drier device 10 is generally illustrated. Photographic paper 12 as photosensitive material, which is processed by a processor component 11 of a printer/processor, is dried by the drier device 10 and ejected on a tray 13. To reduce the size of the printer/processor, the drier device 10 is constructed to convey the photographic paper 12 in an upward direction with an inclination. Note that the printer/processor is an apparatus which includes a printer component in which images on developed photo film are printed on the photographic paper 12, and the processor component 11 for automatically developing the photographic paper 12.

The drier device 10 is constituted by an endless conveyor belt 15, an air blow case 16, a heater unit 17, a fan or blower 18, an air blow duct 19, an air intake case 20 or suction case, and an air intake duct 21 or suction duct.

Belt rollers 25 and 26 are disposed near to ends of the air intake case 20 for circulation of the conveyor belt 15. A motor 27 is connected with the belt roller 25. The conveyor belt 15 is driven by the motor 27 to circulate in the clockwise direction so that the photographic paper 12 is conveyed up along the inclined conveying path. The conveyor belt 15 is a mesh belt produced from polyester threads having a diameter of 1.1 mm, and provided with a great number of air openings which are defined between the threads, are rectangular, and have an open area of 4 $mm^2$. A coating of silicone rubber is applied to the conveyor belt 15 for avoiding slipping in contact with the photographic paper 12. The coefficient of friction of the conveyor belt 15 is 0.5 or more.

Figure 2:
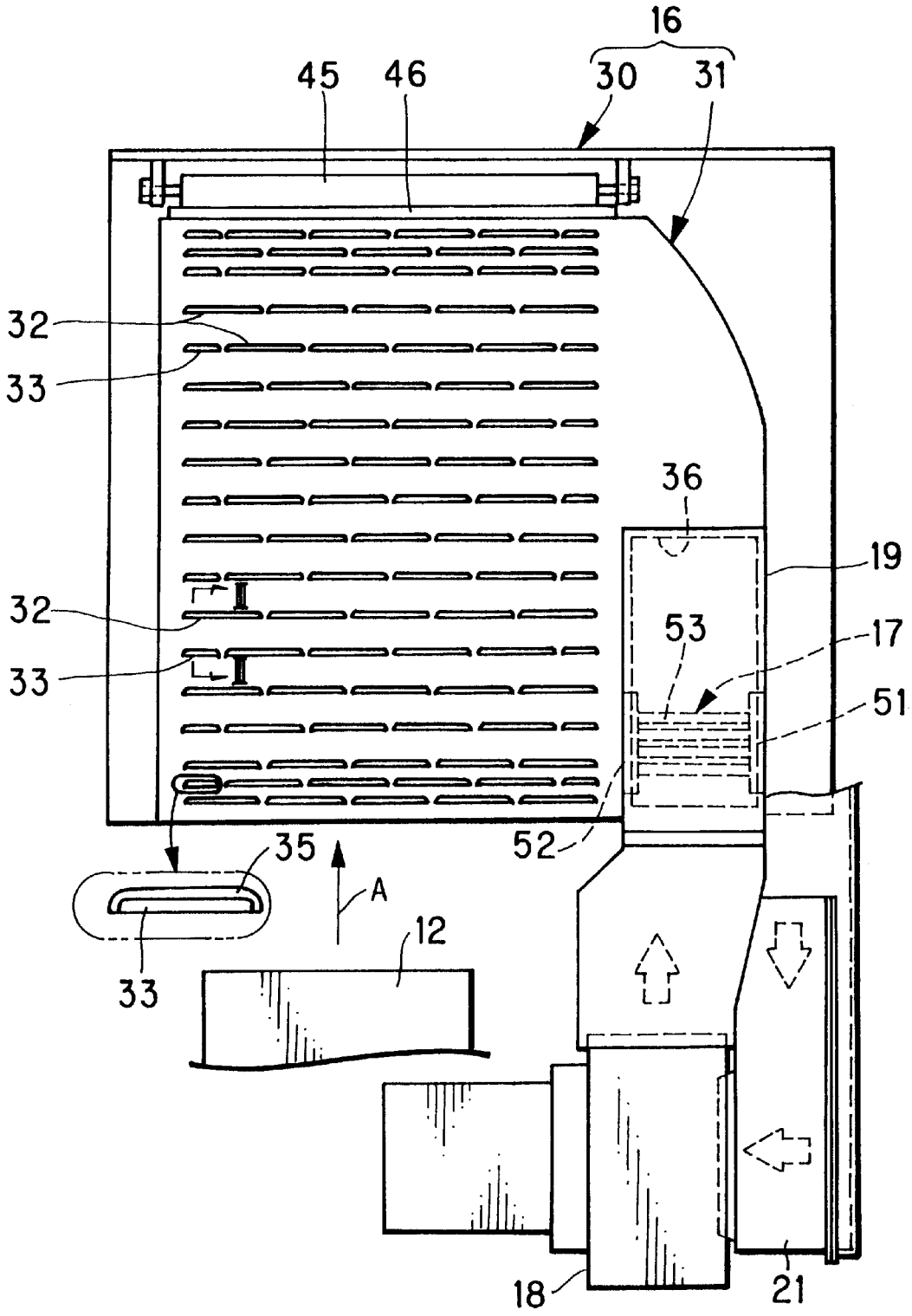
FIG. 2 is an explanatory view in elevation, illustrating an air blow wall of an air blow case.

The air blow case 16 is disposed opposite to the conveying face of the conveyor belt 15, and positioned in the conveying path. In FIG. 2, the air blow case 16 includes a box-shaped case body 30 and an air blow wall 31. Each of the case body 30 and the air blow wall 31 is molded from synthetic resin.

Trains of outlet slits 32 and 33 are formed in the air blow wall 31. The plural slit trains, for example 18 trains, are arranged in the conveying direction A of the photographic paper 12. Each of the trains of the outlet slits 32 and 33 includes five or six outlet slits arranged in a direction crosswise to the conveying direction A. The pitch of the trains of the outlet slits 32 and 33 is predetermined in the conveying direction A. Slits included in a first one of the trains of the outlet slits 32 and 33 are positioned offset in the crosswise direction from slits included in a second one of the trains adjacent to the first train in the conveying direction A. Thus the first train includes five slits 32 of a regular length. The second train includes four slits 32 of the regular length and the two slits 33 of a length half as great as that of the slits 32. Air passed through the outlet slits 32 and 33 are applied to emulsion surface of the photographic paper 12 in a regular manner. Unevenness in the drying operation is prevented. An interval between the trains of the outlet slits 32 and 33 is reduced in the vicinity of the entrance and exit of the air blow wall 31 for the photographic paper 12, so as to avoid reduction in the amount of air to flow.

Figure 3:
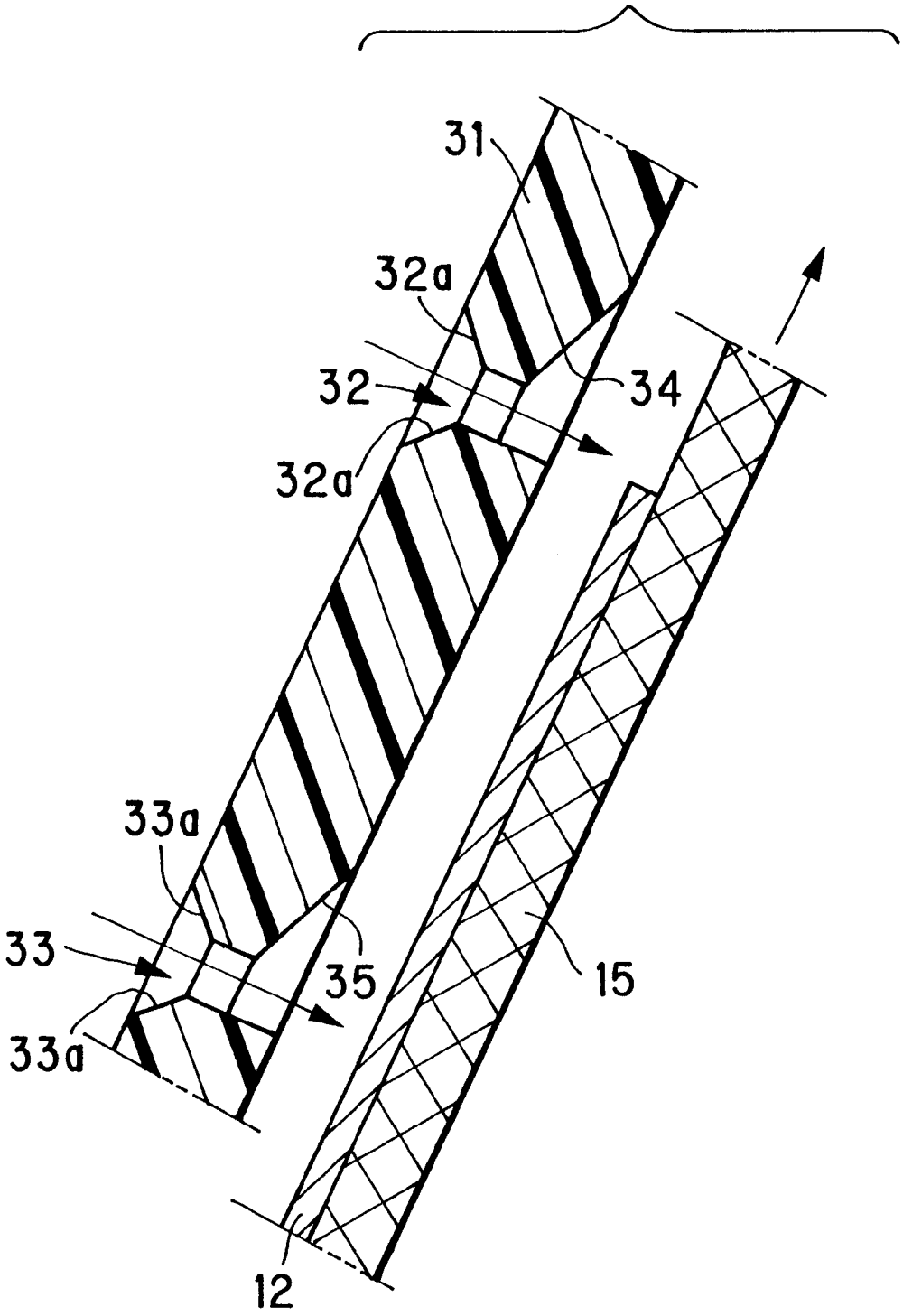
FIG. 3 is a section, partially broken and taken on line III—III in FIG. 2, illustrating outlet slits of the air blow case.

FIG. 3 is a section illustrating the outlet slits 32 and 33, taken on line parallel to the conveying direction of the photographic paper. Outer inclined guiding surfaces 34 and 35 are formed with the air blow wall 31 by cutting one of edges of each of the outlet slits 32 and 33 located downstream in the conveying direction. It is likely that the photographic paper 12 is curled by the hot air during conveyance, and that one of two front corners of the photographic paper 12 enters the outlet slits 32 and 33. However, the outer inclined guiding surfaces 34 and 35 guide the corners and keep them out of the outlet slits 32 and 33. Thus the corners do not interfere with the outlet slits 32 and 33. It is possible to avoid jamming of the photographic paper 12 and damaging of the front corners of the photographic paper 12.

As the outer inclined guiding surfaces 34 and 35 exist, the width of the outlet slits 32 and 33 increases in the direction toward the photographic paper 12. Loss in the pressure is prevented at the outlet slits 32 and 33 for the air to flow. Let an open proportion of the air blow wall 31 be a proportion of a total area of the outlet slits 32 and 33 to a total area of an operating region of the air blow wall 31 except for the outer inclined guiding surfaces 34 and 35. A preferable range of the open proportion is 5–20% in view of efficiency in the drying operation.

Furthermore, inner inclined guiding surface 32*a* and 33*a* are formed with the air blow wall 31 and inside the air blow case 16, and inclined by chamfering at least one of two edges of the outlet slits 32 and 33. The inner inclined guiding surface 32*a* and 33*a* operate to reduce resistance of the inside of the air blow wall 31 to the air flowing to the inside of the outlet slits 32 and 33, so as to obtain the flow rate and pressure of the air toward the photographic paper 12.

Figure 4:
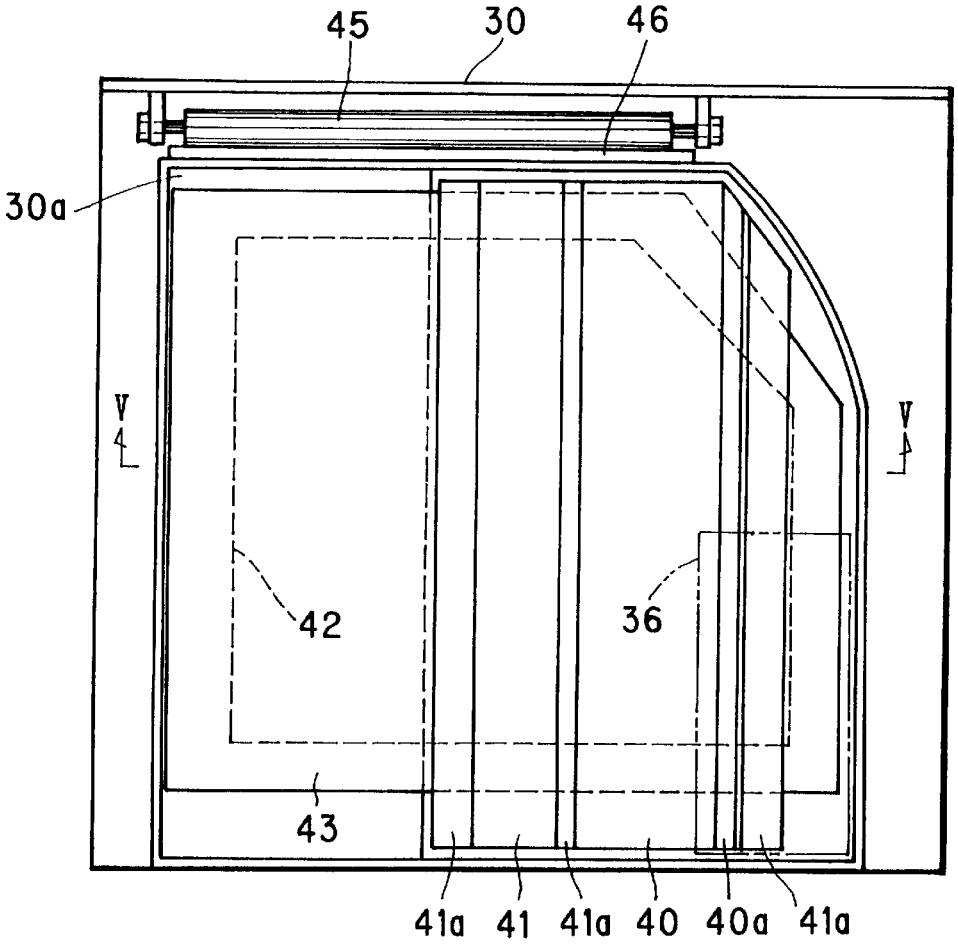
FIG. 4 is a plan illustrating the air blow case in a state where the air blow wall is eliminated.
Figure 5:
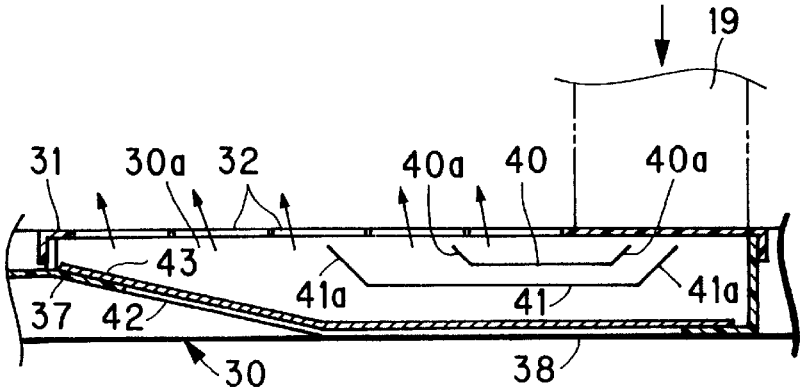
FIG. 5 is a section, taken on line V—V in FIG. 4, illustrating the air blow case.

In FIGS. 4 and 5, an air blow chamber 30*a* of the case body 30 has an inclined straightener portion 37, which is included in a base wall of the air blow chamber 30*a*, disposed opposite to a duct connecting gap 36, and shaped with an inclination. A parallel base wall portion 38 is also included in the base wall, adjacent to the inclined straightener portion 37, and parallel with the air blow wall 31. The flowing air, therefore, can be guided efficiently by the inclined straightener portion 37 as well as the parallel base wall portion 38.

Two straightener plates 40 and 41 are disposed in the air blow case 16 to extend along the air blow wall 31 for keeping the amount of the air to flow from reduction in the center of the air blow wall 31 in a width direction of the photographic paper 12. Lateral edges 40*a* and 41*a* of the straightener plates 40 and 41 are bent up with an inclination, to guide the air from the air blow duct 19 to positions of the air blow wall 31 widely.

A middle opening 42 is formed in the middle of the bottom wall having the inclined straightener portion 37 and the parallel base wall portion 38. The middle opening 42 reduces the amount of resin for molding the case body 30, and also prevents occurrence in molding distortion due to sink mark upon the molding of the case body 30. A thin metal plate 43 is attached to close the middle opening 42.

Figure 6:
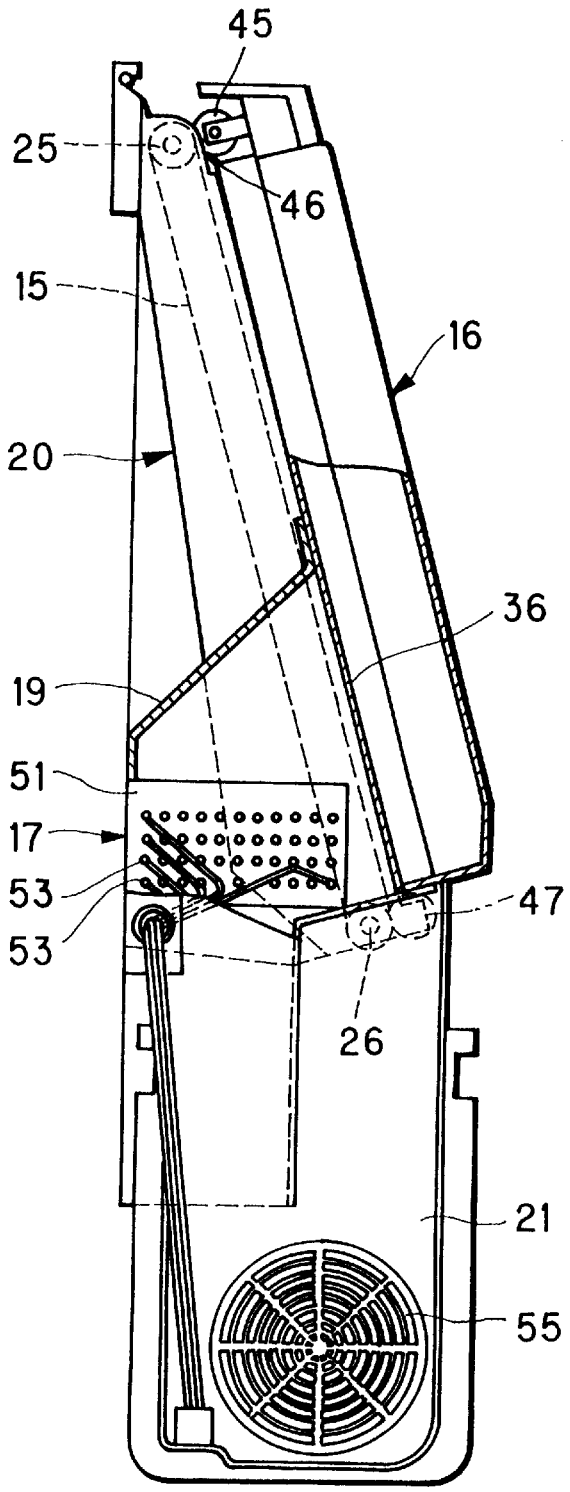
FIG. 6 is a left side elevation, partially cutaway, illustrating the drier device.

A push roller 45 is supported on a top of the case body 30 in a rotatable manner. In FIG. 6, the push roller 45 is pressed against the belt roller 25 of the conveyor belt 15, to nip the photographic paper 12 between it and the conveyor belt 15 and to send the photographic paper 12 out of the drier device 10 to the tray 13. A guiding plate 46 is disposed between the push roller 45 and a top end of the air blow wall 31, and guides the photographic paper 12 to the nipping position between the push roller 45 and the conveyor belt 15.

Also, a push roller 47 is disposed near to the belt roller 26 of the conveyor belt 15. The photographic paper 12 is sent into the drier device 10 through the processor component 11 while nipped between the push roller 47 and the conveyor belt 15.

Figure 7:
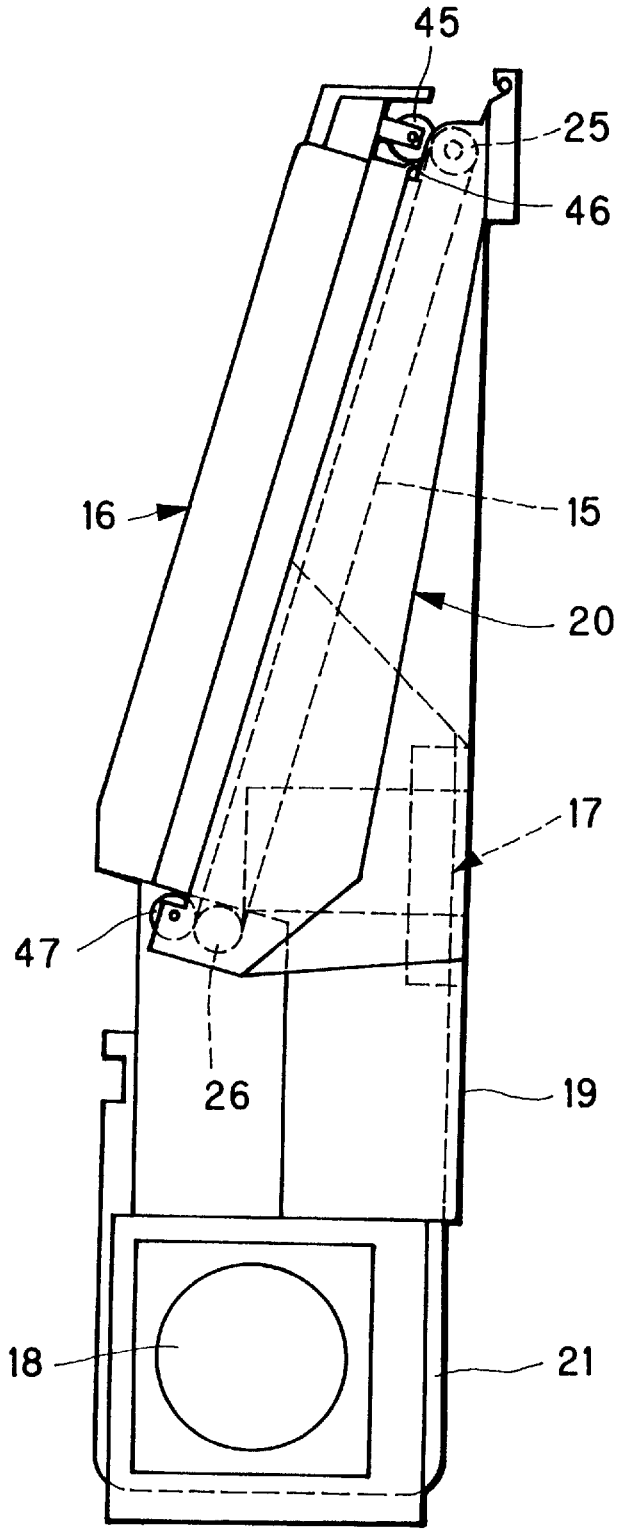
FIG. 7 is a right side elevation illustrating the drier device.

In FIG. 2, the duct connecting gap 36 is located in a lower region in the right-hand extension portion of the air blow case 16, and connects the air blow case 16 with the air blow duct 19. In FIGS. 6 and 7, the heater unit 17 is disposed in the air blow duct 19 in a removable manner. The heater unit 17 is constituted by a great number of coil-type heaters 53 arranged between support plates 51 and 52. When the air from the fan or blower 18 is passed through the heaters 53, the air becomes hot for the drying operation.

The air intake case 20, illustrated in FIG. 6, is connected to an intake side of the fan or blower 18 by the air intake duct 21. Air intake gaps 55 are formed in the air intake duct 21. Air from the air blow case 16 is forcibly drawn through the openings of the conveyor belt 15 and its sides, and taken in by the fan or blower 18 for circulation.

The operation of the above embodiment is described now. In FIG. 1, the photographic paper 12 of a cut sheet type in a rectangular shape, which has been processed by the processor component 11, is nipped between the push roller 47 and the conveyor belt 15, and moved in contact with the conveyor belt 15. The photographic paper 12 is oriented to direct its emulsion surface away from the conveyor belt 15.

The air from the fan or blower 18 is heated by the heater unit 17 and sent into the air blow case 16. In FIG. 5, the air is guided by the straightener plates 40 and 41 in the air blow case 16, and is caused to flow out of the outlet slits 32 and 33 in the air blow wall 31. The air is applied to the photographic paper 12, blows the photographic paper 12, and presses the photographic paper 12 against the conveyor belt 15. In FIG. 1, rotation of the conveyor belt 15 conveys the photographic paper 12 in the conveying path defined along the air blow case 16, while the photographic paper 12 is dried. The photographic paper 12 while on the conveyor belt 15 is sucked through the air intake case 20. The photographic paper 12 is kept in tight contact with the conveyor belt 15. The photographic paper 12 is reliably conveyed.

The photographic paper 12 is kept in tight contact with the conveyor belt 15 both by the air blow from the air blow case 16 and by the suction to the air intake case 20. If a curling tendency is created in the photographic paper 12 by the drying operation, the photographic paper 12 is prevented from having a curled shape. Should the corners of the photographic paper 12 be curled in a direction toward the outlet slits 32 and 33, the outer inclined guiding surfaces 34 and 35 can guide the corners of the photographic paper 12 out of the outlet slits 32 and 33. Thus, the photographic paper 12 is prevented from jamming or having a bend at each of its corners.

In FIG. 2, the lengths of the outlet slits 32 and 33 are smaller than the width of the photographic paper 12. There are intervals between two adjacent ones of the outlet slits 32 and 33. Thus the photographic paper 12 is kept from entering the air blow case 16. There occurs no accidental combustion due to a contact of the photographic paper 12 with the heater unit 17. As the outlet slits 32 and 33 are offset between the adjacent trains in the direction crosswise to the conveying direction, irregularities in the blowing of the air to the photographic paper 12 are suppressed. No unevenness in the drying occurs.

The photographic paper 12 being dried is introduced by the guiding plate 46 to the nipping position between the conveyor belt 15 and the push roller 45. It is possible to avoid interference of the push roller 45 with the front corners of the photographic paper 12, and to protect the corners from being bent.

The thickness of the threads of the conveyor belt 15 is not limited to the above value. The diameter of the threads may be in a range of 1.1–1.5 mm. The open area of the openings of the conveyor belt 15 can be preferably great in a range of not lowering the strength of the belt. Instead of the above-described coating, any suitable type of a coating may be used for the purpose of increasing the friction coefficient. Examples of resin for producing the threads may be polyethylene terephthalate (PET) and polyether ether ketone (PEEK). In the above embodiments, the threads are coated with the silicone rubber. However, the silicone rubber may be previously impregnated in the threads for the conveyor belt 15.

Instead of the mesh belt, an endless belt disclosed in JP-A 9-43826 may be used. Such an endless belt includes a great number of suction holes as through holes. Also, a plurality of endless belts may be arranged in parallel with each other and may convey the photographic paper 12. Furthermore, a plurality of conveying rollers may be arranged and driven in the conveying direction.

Each of the outlet slits 32 and 33 extends in the direction crosswise to the direction A of the conveyance. However, the outlet slits 32 and 33 can be directed in any angle with reference to the conveying direction A.

In the above embodiments, the photographic paper 12 is dried. Furthermore, the construction of the present invention can dry any flat material of film or sheet. The material may be continuous.

In the above embodiments, the photographic paper 12 is conveyed up with the inclination. However, the photographic paper 12 may be conveyed in any direction, namely up or down vertically, or horizontally with or without an inclination.

In the above embodiments, the shapes of the air blow duct 19 and the air intake duct 21 in FIG. 1 are simplified only for facilitation in understanding, and actually have such shapes of FIGS. 5–7 that the air flows in an "8"-shaped path in FIG. 6. To be precise, the air is initially sent from the fan or blower 18 straight upwards to the heater unit 17, then sent through the air blow duct 19 into the air blow case 16 in the direction from the back surface to the emulsion surface of the photographic paper 12, sent through the air blow wall 31 and the conveyor belt 15 into the air intake case 20 in the direction from the emulsion surface to the back surface, and sent from the air intake case 20 straight down to the air intake duct 21 and the fan or blower 18.

Alternatively the shapes of the air blow duct 19 and the air intake duct 21 can be actually shaped in such a manner that the air flows in a loop-shaped path of FIG. 1.

In the above embodiment, the outlet slits 32 and 33 are offset between the adjacent trains of slits. However, the outlet slits 32 and 33 may be regularly arranged in a manner of a matrix without the offset state.

In the above embodiments, each of the trains of the outlet slits 32 and 33 include five or six slits. However each of the slit trains may consists of a single outlet slit.

In the above embodiments, the case body 30 and the air blow wall 31 are formed from resin. Also, the case body 30 and the air blow wall 31 may be produced from metal or any suitable material.

In the above embodiments, the air flows along the path shaped in a closed loop. But a path of an open loop may be used for flow of air. The air can be collected by the air intake case 20 and exhausted to the outside of the drier device through the air intake duct 21. The fan or blower 18 can be supplied only with fresh air from the outside. Furthermore, the air intake duct 21 and the air intake case 20 may be eliminated from the drier device, so that only the air blow case 16 and the fan or blower 18 cooperate for the drying operation.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A drier device for photosensitive material, including a conveyor for conveying said photosensitive material along a predetermined conveying path, and a fan or blower for drying said photosensitive material by application of air thereto while said photosensitive material is conveyed along said conveying path, said drier device comprising:

an air blow case into which said fan or blower sends said air, said air blow case having an air blow wall extending along said conveying path, and being positioned opposite to said photosensitive material; and plural outlet slits, formed through said air blow wall, for blowing said photosensitive material with said air, wherein each of said outlet slits extends in a crosswise direction crosswise to said conveying path, said outlet slits are arranged in N trains arranged along said conveying path, and each of said outlet slits has a length smaller than a width of said photosensitive material.

2. A drier device as defined in claim 1, wherein said N trains include first and second trains substantially parallel with one another;

said first train includes P of said plural outlet slits;

said second train includes Q of said plural outlet slits, and offset in said crosswise direction from said P outlet slits.

3. A drier device as defined in claim 1, further comprising an outer inclined guiding surface, formed with said air blow wall and outside said air blow case, and inclined by chamfering one of two edges of said outlet slits located downstream with reference to said conveying path, for preventing said outlet slits from interfering with an edge of said photosensitive material.

4. A drier device as defined in claim 1, further comprising an inner inclined guiding surface, formed with said air blow wall and inside said air blow case, and inclined by chamfering at least one of two edges of said outlet slits.

5. A drier device as defined in claim 1, further comprising a straightener, disposed in said air blow case, for regularizing a flow rate of said air between said plural outlet slits.

6. A drier device as defined in claim 5, further comprising an air blow duct for introducing said air from said fan or blower to said air blow case;

said air blow case further including a duct connecting gap connected with said air blow duct;

wherein said straightener introduces part of said air to ones of said outlet slits farther from said duct connecting gap with reference to said crosswise direction.

7. A drier device as defined in claim 6, wherein said air blow case further includes an extension portion disposed to extend from one of said conveying path, and having said duct connecting gap formed therein;

wherein said straightener includes at least one plate having first and second edges, said first edge being positioned opposite to one middle position in said duct connecting gap, and said second edge being positioned opposite to one middle position in said air blow wall.

8. A drier device as defined in claim 6, wherein said air blow case further includes a base wall disposed opposite to said air blow wall, and having a portion, disposed opposite to said extension portion, and inclined with a decreasing height toward said air blow wall.

9. A drier device as defined in claim 1, wherein said air blow wall is produced from resin.

10. A drier device as defined in claim 1, wherein a proportion of a total of open areas of said outlet slits to an area of said air blow wall is 5–20%.

11. A drier device as defined in claim 1, wherein said conveyor includes a conveyor belt, and said conveyor belt has a plurality of air openings.

12. A drier device as defined in claim 11, further comprising:

a push roller, positioned opposite to an end of said conveyor belt disposed downstream with reference to said conveying path, for nipping said photosensitive material in cooperation with said conveyor belt; and a guiding plate, disposed near to said push roller, for introducing said photosensitive material toward said push roller.

13. A drier device as defined in claim 6, further comprising:

an air intake case for covering a back of said conveyor; and an air intake duct, for connecting said air intake case to said air blow duct, said fan or blower being disposed between said air intake duct and said air blow duct, to circulate said air.

14. A drier device for photosensitive material, including a conveyor for conveying said photosensitive material along a predetermined conveying path, and a fan or blower for drying said photosensitive material by application of air thereto while said photosensitive material is conveyed along said conveying path, said drier device comprising:

an air blow case into which said fan or blower sends said air, said air blow case having an air blow wall extending along said conveying path, and being positioned opposite to said photosensitive material;

plural outlet slits, formed through said air blow wall, for blowing said photosensitive material with said air, wherein each of said outlet slits extends in a crosswise direction crosswise to said conveying path, said outlet slits are arranged in N trains arranged along said conveying path; and an outer inclined guiding surface, formed with said air blow wall and outside said air blow case, and inclined by chamfering one of two edges of said outlet slits located downstream with reference to said conveying path, for preventing said outlet slits from interfering with an edge of said photosensitive material.

15. A drier device as defined in claim 14, further comprising a straightener, disposed in said air blow case, for regularizing a flow rate of said air between said plural outlet slits.

16. A drier device as defined in claim 14, wherein said conveyor includes a conveyor belt, and said conveyor belt has a plurality of air openings.

17. A drier device as defined in claim 16, further comprising:

a push roller, positioned opposite to an end of said conveyor belt disposed downstream with reference to said conveying path, for nipping said photosensitive material in cooperation with said conveyor belt; and a guiding plate, disposed near to said push roller, for introducing said photosensitive material toward said push roller.

18. A drier device for photosensitive material, including a conveyor for conveying said photosensitive material along a predetermined conveying path, and a fan or blower for drying said photosensitive material by application of air thereto while said photosensitive material is conveyed along said conveying path, said drier device comprising:

an air blow case into which said fan or blower sends said air, said air blow case having an air blow wall extending along said conveying path, and being positioned opposite to said photosensitive material;

plural outlet slits, formed through said air blow wall, for blowing said photosensitive material with said air, wherein each of said outlet slits extends in a crosswise direction crosswise to said conveying path, said outlet slits are arranged in N trains arranged along said conveying path; and an inner inclined guiding surface, formed with said air blow wall and inside said air blow case, and inclined by chamfering at least one of two edges of said outlet slits.

* * * * *